US008539730B2

(12) United States Patent
Madsen et al.

(10) Patent No.: US 8,539,730 B2
(45) Date of Patent: Sep. 24, 2013

(54) BUILDING SYSTEM

(75) Inventors: Tyge Madsen, Ascot (AU); Klaus Hammershoit Hansen, Ascot (AU)

(73) Assignee: Tripod Components Pty Ltd., Ascot (AU)

( * ) Notice: Subject to any disclaimer, the term of this patent is extended or adjusted under 35 U.S.C. 154(b) by 989 days.

(21) Appl. No.: 11/629,702

(22) PCT Filed: Jun. 14, 2005

(86) PCT No.: PCT/AU2005/000837

§ 371 (c)(1),
(2), (4) Date: Apr. 16, 2007

(87) PCT Pub. No.: WO2005/124049

PCT Pub. Date: Dec. 29, 2005

(65) Prior Publication Data

US 2008/0040986 A1 Feb. 21, 2008

(30) Foreign Application Priority Data

Jun. 15, 2004 (AU) ..... 2004903227
Jul. 20, 2004 (AU) ..... 2004903976

(51) Int. Cl.
*E04B 1/18* (2006.01)

(52) U.S. Cl.
USPC ..... 52/634; 52/537; 52/844; 52/798.1

(58) Field of Classification Search
USPC ..... 52/783.18, 792.12, 798.1, 836, 842, 52/843, 844, 537, 591.4
See application file for complete search history.

(56) References Cited

U.S. PATENT DOCUMENTS

| | | | | | |
|---|---|---|---|---|---|
| 3,282,615 | A * | 11/1966 | Darby et al. | ..... | 52/783.18 |
| 3,538,668 | A * | 11/1970 | Anderson | ..... | 52/783.18 |
| 3,872,641 | A * | 3/1975 | Falkenberg | ..... | 52/783.18 |
| 4,558,549 | A * | 12/1985 | See | ..... | 52/220.2 |
| 5,380,579 | A * | 1/1995 | Bianchi | ..... | 428/184 |
| 5,612,117 | A * | 3/1997 | Belanger et al. | ..... | 428/178 |
| 5,636,489 | A | 6/1997 | Leverrier et al. | | |
| 7,770,354 | B2 * | 8/2010 | Bui | ..... | 52/783.11 |
| 2004/0040256 | A1 * | 3/2004 | Bui | ..... | 52/782.1 |

FOREIGN PATENT DOCUMENTS

| | | | |
|---|---|---|---|
| BE | 852 695 | | 7/1977 |
| DE | 28 02 151 | | 7/1979 |
| DE | 3641970 | A1 * | 2/1988 |
| DE | 0 367 976 | | 11/1988 |
| DE | 201 16 551 | U1 | 12/2001 |
| EP | 0 612 896 | A1 | 8/1994 |

(Continued)

OTHER PUBLICATIONS

Supplementary European Search Report dated Jun. 16, 2011 issued in the corresponding European Patent Application No. 05 75 0244.

*Primary Examiner* — Brian Glessner
*Assistant Examiner* — Adam Barlow
(74) *Attorney, Agent, or Firm* — Buchanan Ingersoll & Rooney PC

(57) ABSTRACT

A building system is disclosed having building constituent assemblies including wall panels, a flooring assembly, a ceiling assembly and a roofing assembly. Each of the building constituent assemblies includes a supporting structure and a covering member. The supporting structure includes a supporting member which has a corrugated first side portion and second side portion. The side portions of adjacent supporting structures overlay each other and interlock the adjacent constituent assemblies together.

7 Claims, 13 Drawing Sheets

(56) References Cited

FOREIGN PATENT DOCUMENTS

| | | | |
|---|---|---|---|
| FR | 2 313 517 | A1 | 12/1976 |
| FR | 2 589 904 | A1 | 5/1987 |
| GB | 1 208 608 | A | 10/1970 |
| GB | 2 234 997 | | 2/1991 |
| JP | 2001-140411 | A | 5/2001 |

* cited by examiner

BUILDING SYSTEM

FIELD OF THE INVENTION

The present invention relates to a building system.

BACKGROUND TO THE INVENTION

There are several known approaches to the construction of buildings such as houses. These approaches include the use of bricks and mortar, the use of pre-cast concrete panels and the construction of a frame for upon which cladding is affixed.

These approaches all require considerable work to be done at the site of the building. An alternative approach is construct a building at a location, and then transport the building to the site on which it is to be located. The logistics of this alternative approach are quite complex, and such an approach clearly limits the size and shape of the building able to utilise such a method.

Building constituents such as walls, floors, ceilings and roofs are generally constructed by erecting a supporting structure, and then mounting the constituent to the supporting structure. Such an approach requires the entire supporting structure of the constituent to be fixed in position before the constituent can be mounted.

Building constituents such as walls, floors, ceilings and roofs, along with their associated supporting structure, can be supplied to a building site as raw building materials or in a partially assembled form. Supplying the raw materials requires a great deal of specialised construction work to be undertaken at the site. Supplying the constituents in a partially assembled form can reduce this problem, however the partially assembled constituents are often bulky and difficult to transport.

The present invention attempts to overcome at least in part some of the aforementioned disadvantages of previous building methods.

SUMMARY OF THE INVENTION

In accordance with one aspect of the present invention there is provided a building constituent assembly comprising at least one covering member and at least one supporting structure, the supporting structure including a plurality of supporting members each having first and second side portions located adjacent a covering member, characterised in that the first side portion of a first supporting member is complementary in shape to the second side portion of a second supporting member such that the first and second supporting members can engage each other by the overlay of the first side portion of the first supporting member and the second side portion of the second supporting member, such engagement restraining relative movement of the first and second supporting members in at least one direction. Preferably, the first and second side portions are corrugated.

In accordance with a second aspect of the present invention, there is provided a wall panel comprising a supporting structure and at least one covering member, the supporting structure having at least one supporting member adjacent a covering member, characterised in that the supporting member has as first side portion extending beyond the covering member and a second side portion adjacent the covering member, a receiving area being defined between the second side portion and the covering member, wherein the first side portion of the supporting member of a first wall panel is receivable within the receiving area of a second wall panel, the first side portion being complementary in shape to the second side portion such that the first side portion of the first wall panel engages the second dies portion of the second wall panel, the engagement restraining relative movement of the first and second wall panels in at least one direction and the covering member restraining relative movement of the first and second wall panels in a second direction.

In accordance with a third aspect of the present invention there is provided a building constituent assembly comprising a supporting structure and at least one covering member, characterised in that the supporting structure includes at least one supporting member having as a trough portion which is substantially V-shaped in a transverse direction, the supporting member having first and second side portions on opposed sides of the trough portion, the first side portion of a first supporting member being complementary in shape to the second side portion of a second supporting member such that the first and second supporting members can engage each other by the overlay of the first side portion of the first supporting member and the second side portion of the second supporting member, such engagement restraining relative movement of the first and second supporting members in at least one direction. The building constituent assembly of the third aspect may be a flooring assembly, a ceiling assembly and/or a roofing assembly.

BRIEF DESCRIPTION OF THE DRAWINGS

The present invention will now be described, by way of example, with reference to the accompanying drawings, in which.

DESCRIPTION OF PREFERRED EMBODIMENTS

Figure 1:
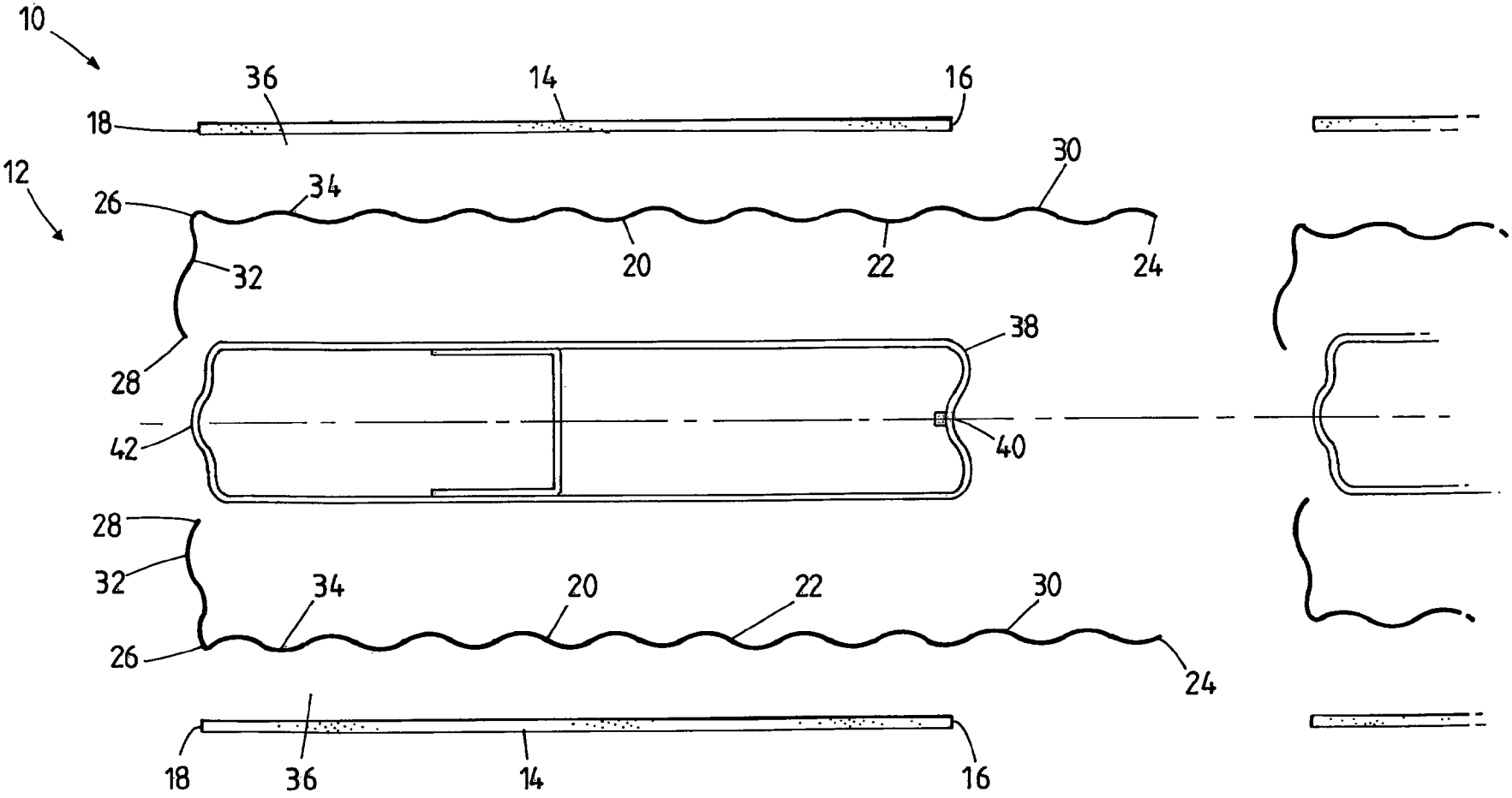
FIG. 1 is an exploded plan view of a wall panel in accordance with the present invention.
Figure 2:
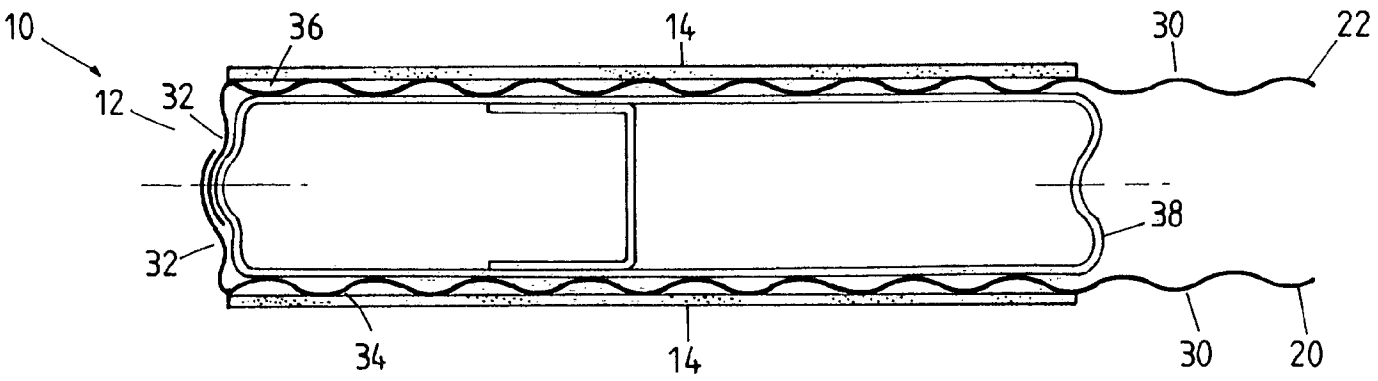
FIG. 2 is a plan view of the wall panel of FIG. 1 shown in an assembled configuration.

Referring FIGS. 1 to 5, there is shown a building constituent assembly comprising a plurality of wall panels 10. Each wall panel 10 comprises a supporting structure 12 and two covering members 14. The covering members 14 are constructed from a suitable building cladding material such as cement sheeting. Each covering member 14 has a front end 16 and a rear end 18.

The supporting structure 12 includes two supporting members 20 in the form of corrugated sheets 22 affixed to each covering member 14. Each corrugated sheet 22 extends from a front end 24 beyond the front end 16 of the covering member 14, to a bend 26 adjacent the rear end 18. Each corrugated sheet 22 is bent at approximately 90° at the bend 26, and extends from the bend 22 to a rear end 28. The rear end 28 is displaced internally of the wall panel 10.

In the embodiment of the drawings, each corrugated sheet 22 has 11.5 wave peaks or corrugations. These are arranged with two wave peaks extending beyond the front end 16 of the corresponding covering member 14, and comprising a first side portion 30 of the supporting member 20; 8 wave peaks lying adjacent the covering member 14; and 1.5 peaks forming a transverse portion 32 extending inwardly of the rear end 18 of the covering member 14.

Each corrugated sheet 22 is fixed to a corresponding covering member 14 by suitable means such as adhesive along the first six peaks closest to the front edge 16 of the covering member 14. The two peaks adjacent the covering member 14, which are closest to the rear edge 18 comprise a second side portion 34 of the supporting member 20. These peaks 34 are not fixed to the covering member 14. A receiving area 36 is thus defined between the second side portion 34 and the covering member 14.

The wall panel 10 further includes a plurality of bracing members 38. The bracing members 38 support the supporting members 20 in opposed parallel relationship. Each bracing member 38 has a front end 40 and a rear end 42. The rear end 42 is at least partially complementary in shape to the portion of the corrugated sheet 22 between the bend 26 and the rear end 28.

Figure 4:
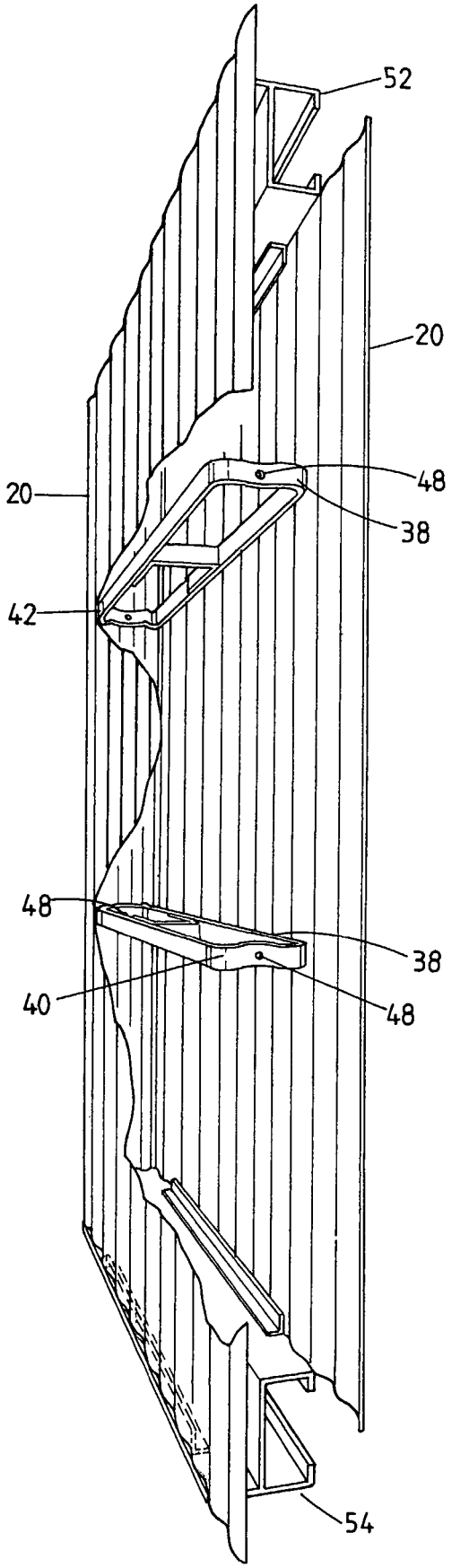
FIG. 4 is a partially cut away perspective view of a supporting structure of the wall panel of FIG. 2.
Figure 5:
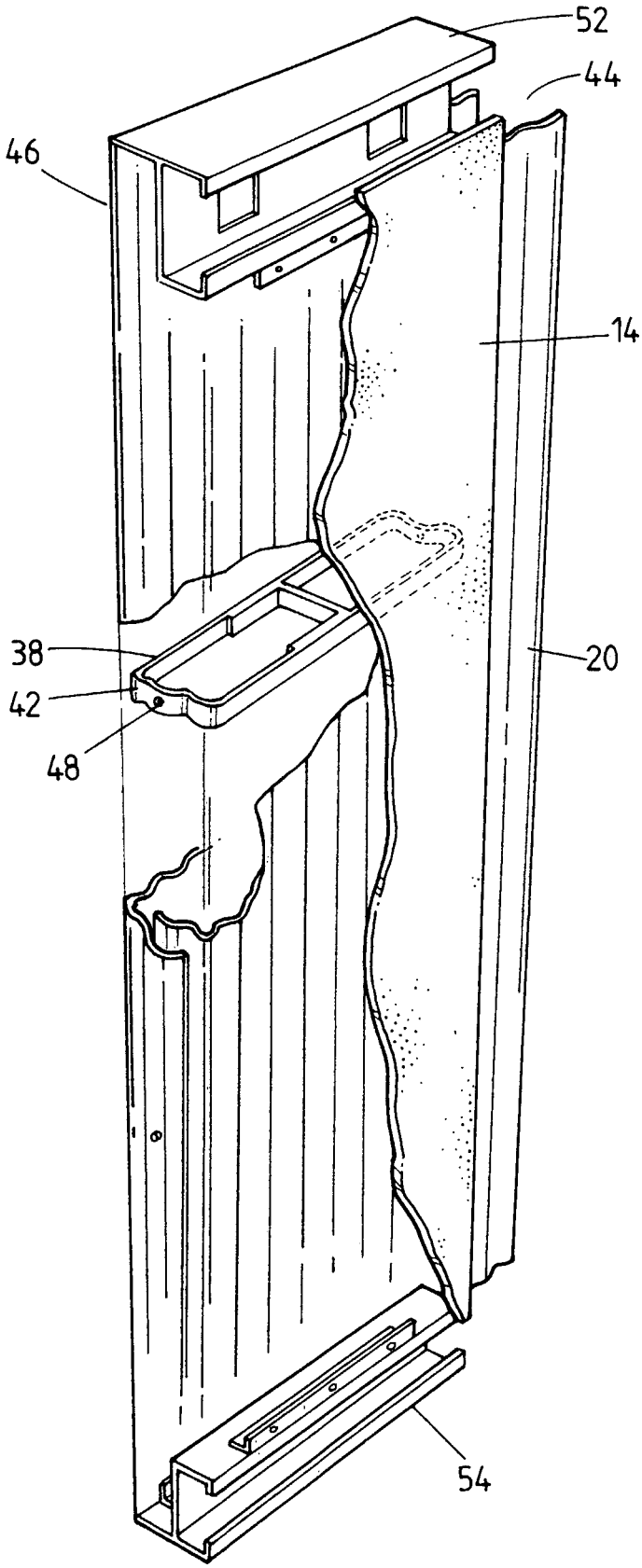
FIG. 5 is a partially cut away perspective view of the wall panel of FIG. 2.

The supporting structure 12 of a wall panel 10 is formed by bringing the two supporting members 20 into the correct opposed relationship, with a plurality of bracing members located therebetween as shown in FIG. 4. In the connected configuration, the transverse portions 32 of the two corrugated sheets 22 overlie one another, and the rear end 42 of the bracing members 38. The covering members 14 are affixed externally of the supporting structure 12, as shown in FIG. 5.

When thus assembled, the wall panel 10 has a male end 44 from which the first side portions 30 of the supporting members 20 protrude, and a female end 46 defined by the second side portions 34.

Figure 3:
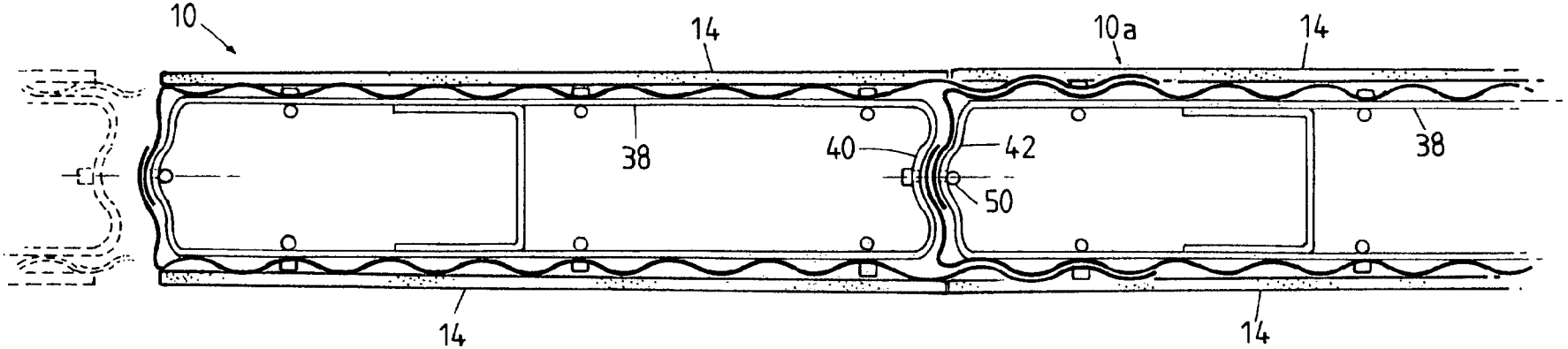
FIG. 3 is a plan view of two wall panels such as that in FIG. 2, shown in a connected configuration.

Successive wall panels 10, 10*a* are connected as shown in FIG. 3.

The first side portions 30 of the supporting members 20 of wall panel 10 are received within the receiving areas 36 of wall panel 10*a*, that is between the second side portions 34 and the covering members 14. It will be appreciated that the corrugations of the first and second side portions 34, 36 are complementary in shape, thus allowing each first side portion 34 to overlay a corresponding second side portion 36.

When in the position shown in FIG. 3, the first side portions 34 of wall panel 10 engage the second side portions 36 of wall panel 10*a*, and thus prevent movement of the two wall panels 10, 10*a* relative to each other in a direction perpendicular to the corrugations. The covering members 14 prevent the disengagement of the first side portions 34 from the second side portions 36 in a direction perpendicular to the covering members 14.

In a preferred embodiment of the wall panel 10, an aperture 48 passes through the front and rear ends 40, 42 of each bracing member 38, and through corresponding locations in the transverse portions 32 of each supporting member 12. Brace members 38 of one wall panel 10 can thus be connected to brace members 38 of an adjacent wall panel 10*a* though bolts 50 or similar connection means.

In a further preferred embodiment of the invention, the covering members 14 are contained within upper and lower extruded channels 52, 54 as seen in FIGS. 4 and 5. Referring to FIGS. 6 to 11, there is shown a building constituent assembly comprising a flooring assembly 60. The flooring assembly 60 comprises a supporting structure 62 and a plurality of substantially planar covering members 64.

Figures 6, 6A:
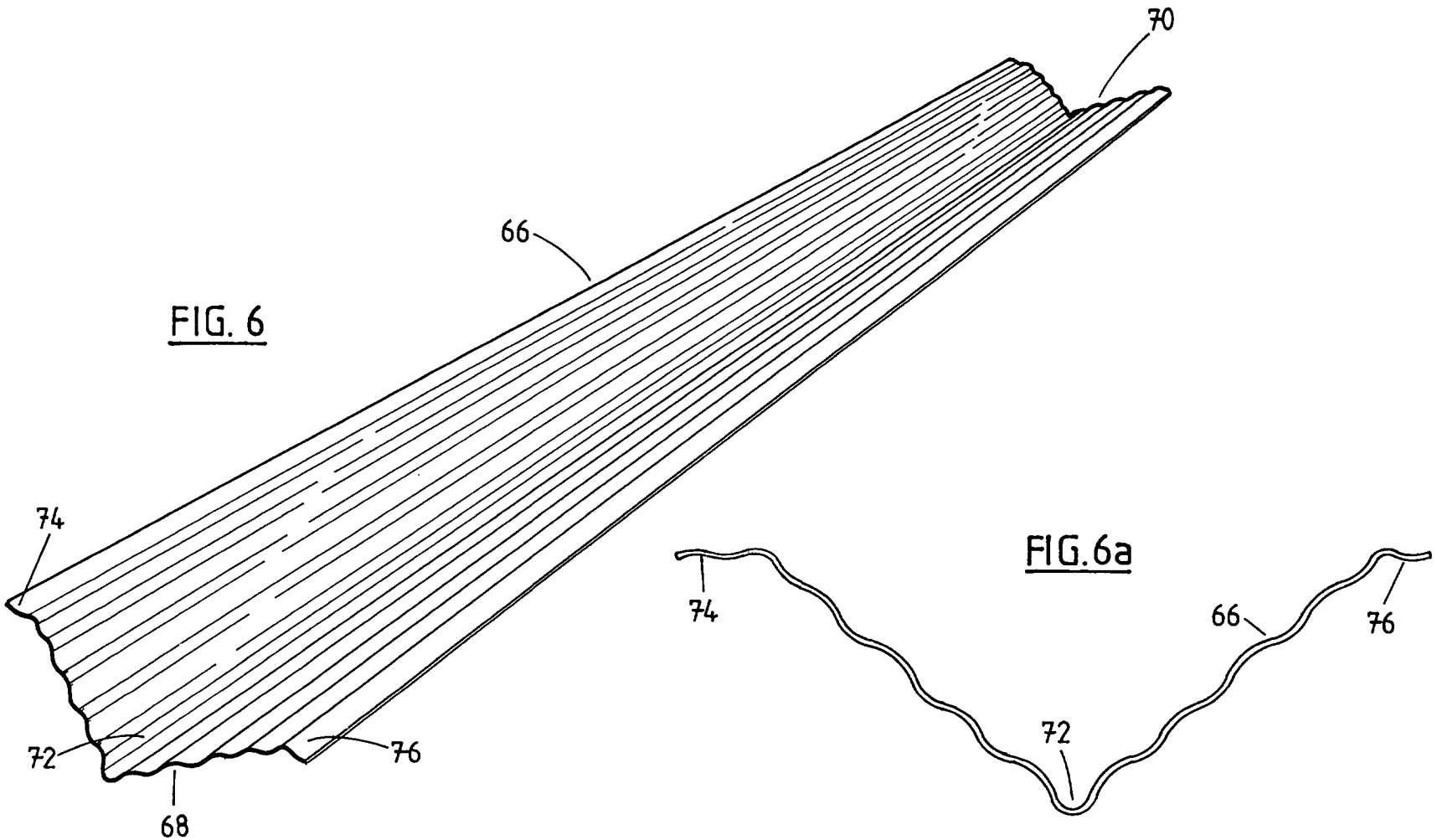
FIG. 6 is a perspective view of a supporting member of a flooring assembly in accordance with the present invention.
FIG. 6*a* is a cross sectional view of the supporting member of FIG. 6.
Figure 7:
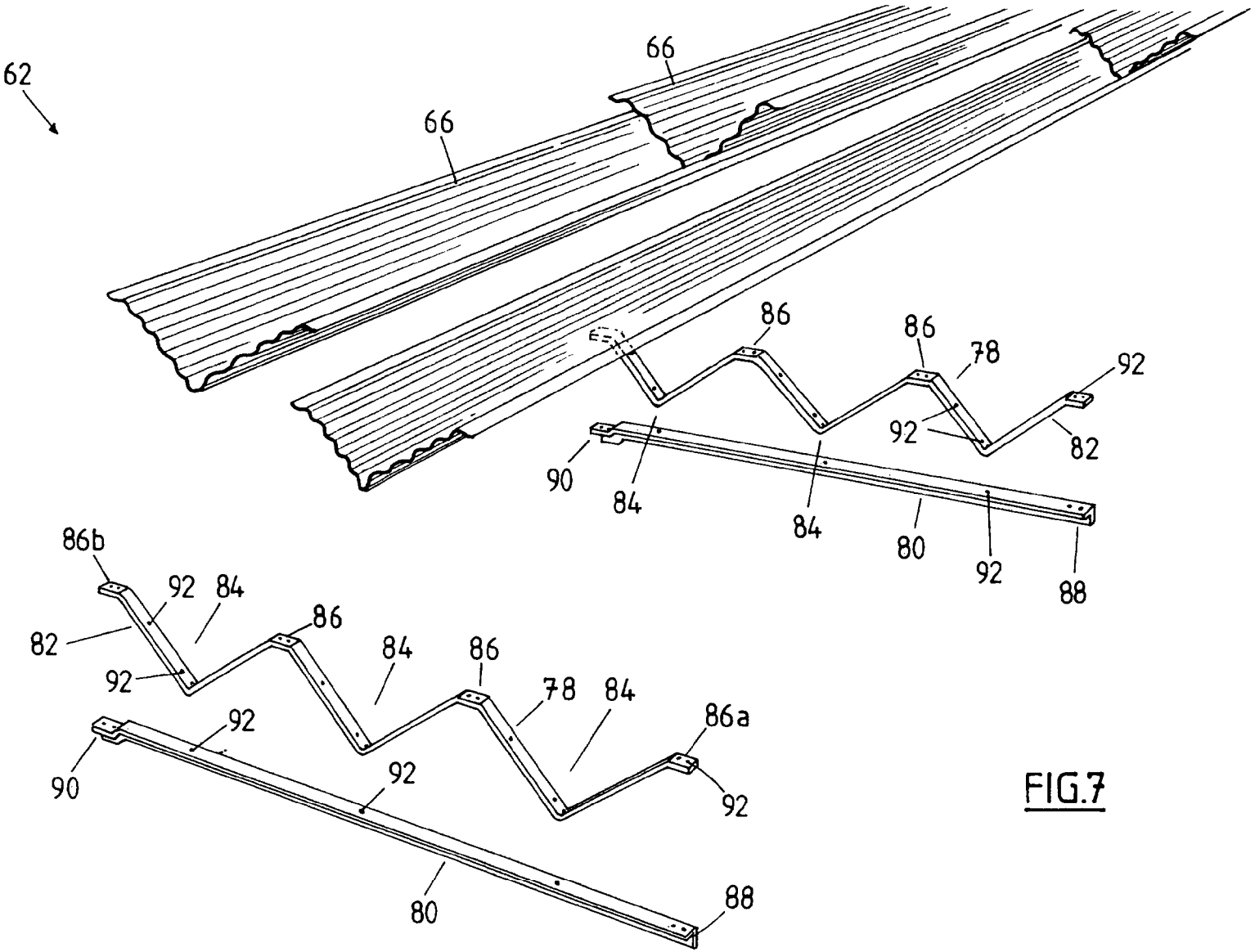
FIG. 7 is an exploded view of a supporting structure of a flooring assembly in accordance with the present invention.
Figure 8:
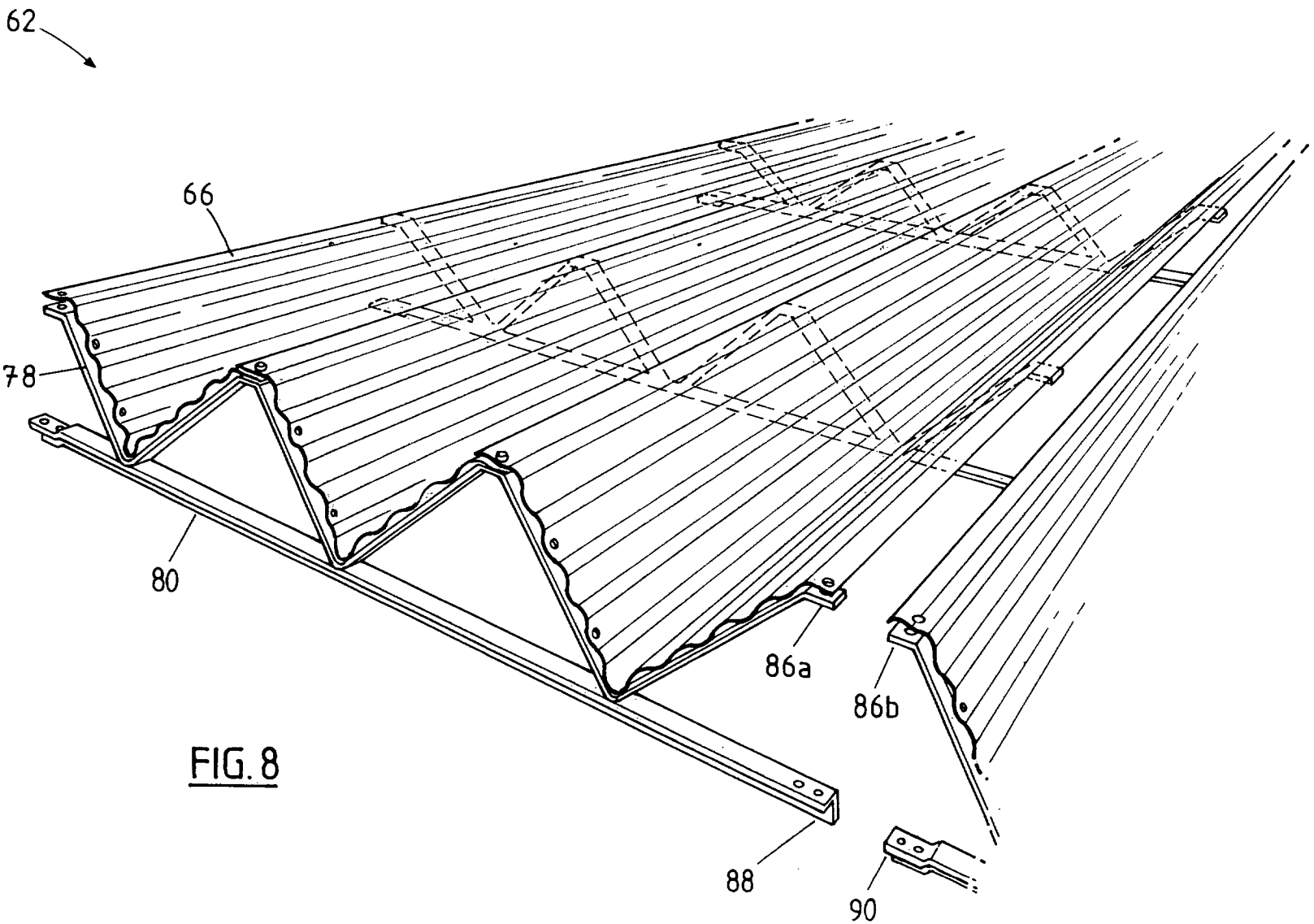
FIG. 8 is a perspective view of the supporting structure of FIG. 7 in an assembled configuration.
Figure 9:
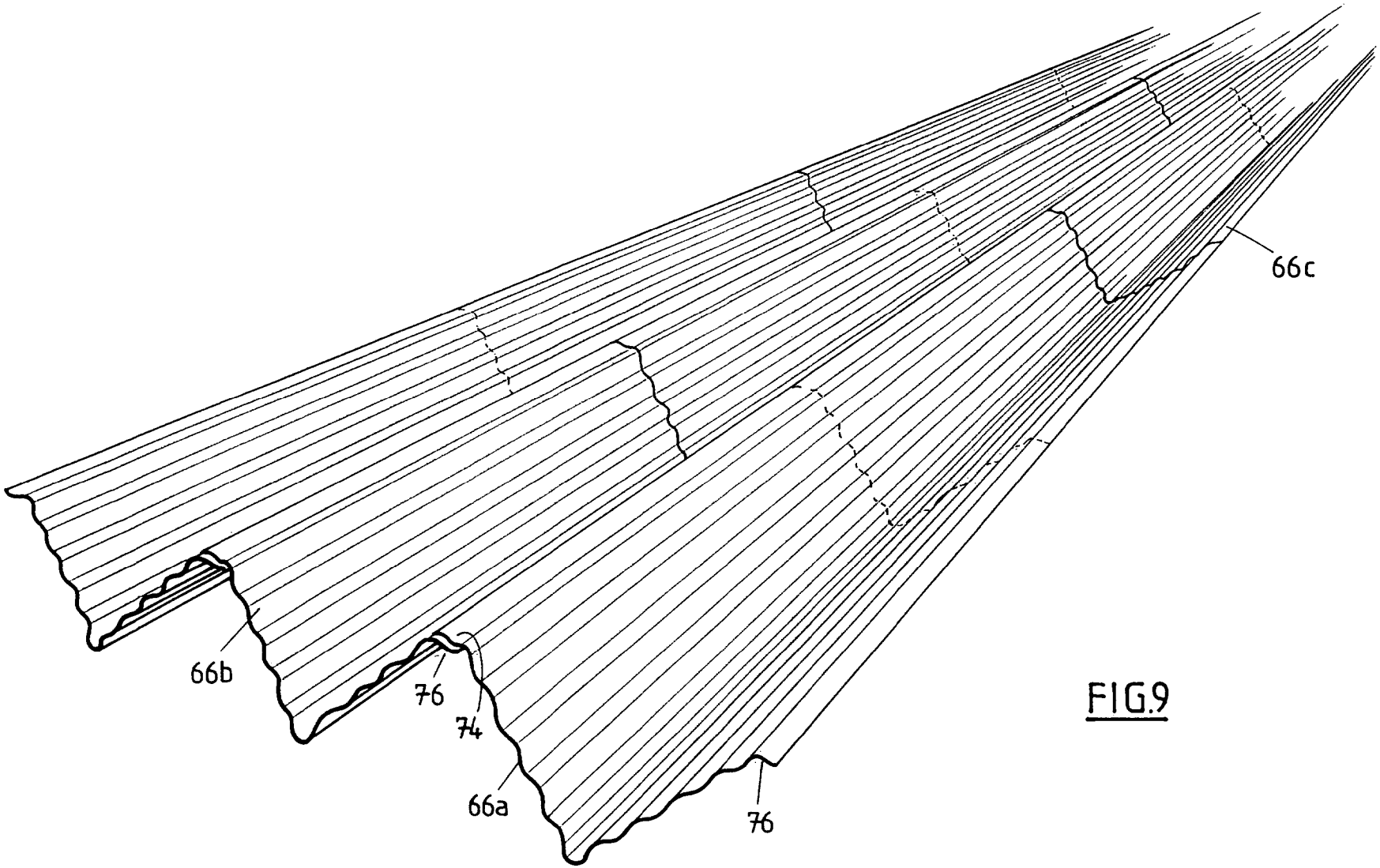
FIG. 9 is an upper perspective view of the supporting structure of FIG. 7.

The supporting structure 62 includes a plurality of supporting members 66 as shown in FIGS. 6 and 6*a*. Each supporting member 66 is elongated, and extends between a first end 68 and a second end 70. Each supporting member 66 is substantially V-shaped in cross section, that is in a transverse direction, with a trough portion 72 extending between the first end 68 and the second end 70.

Each supporting member 66 has a first side portion 74 and a second side portion 76. The first and second side portions 74, 76 are on opposed sides of the trough portion 72, and extend outwardly from the upper ends of the V-shape in a transverse direction.

The supporting members 66 are constructed from a corrugated material having waveforms oriented in the transverse direction. In the embodiment shown in the drawings, the first side portion 74 comprises one waveform, the second side portion 76 comprise one half of a wave form, and each of the side walls of the trough portion 72 comprise four and a half wave forms. A portion of the first side portion 74 is thus complementary in shape to the second side portion 76.

The supporting structure 62 comprises supporting members 66, secondary support members 78 and base members 80. These elements can be seen in FIG. 7.

The secondary support members 78 are preferably formed from a flat metal bar 82 which is bent along its length. The bar is bent to form a plurality of V-shaped sections 84, joined at their upper ends by short horizontal portions 86. The V-shaped sections 84 have a profile similar to that of the trough portion 72 of the supporting members 66. The length of the horizontal portions 86 is similar to the width of the second side portion 76 of the supporting members 66. In use, a plurality of supporting members 66 can be placed along the secondary support member 78, with one supporting member 66 located within each V-shaped section 84.

Each secondary support member 78 has a horizontal portion 86*a*, 86*b* at both outer ends thereof. The horizontal portion 86*b* at a second end of a secondary support member 78 is slightly lower than other horizontal portions 86, all of which are substantially co-planar. This allows a plurality of secondary support members 78 to be connected end to end, with a horizontal portion 86*a* at one end of a first secondary support member 78 located above the horizontal portion 86*b* at the other end of a second secondary support member 78*a*.

It will be appreciated that the number of V-shaped sections 84 along each secondary support member 78, and therefore the length of each secondary support member 78, can be varied for particular applications.

The base members 80 are preferably formed from angle iron lengths having a first end 88 and a second end 90. Each base member 80 has a depression formed at its second end 90, to allow the endwise connection of a plurality of base members 80 whilst maintaining a substantially planar upper surface. Preferably, the base members 80 are similar in length to the secondary support members 78.

A plurality of apertures 92 are located at appropriate points within the supporting members 66, along the secondary support members 78 and in the base members 80. These apertures allow the insertion of suitable fixing devices such as bolts or rivets to hold the secondary support members 78 to the base members 80, and the supporting members 66 to the secondary support members 78, thus forming the supporting structure 62.

In use, the supporting members 66 are effectively tiled in both the elongate and transverse directions. In the transverse direction, adjacent supporting members 66 engage each other by overlay of the first side portion 74 of a first supporting member 66*a* and the second side portion 76 of the second supporting member 66*b*. In the elongate direction, adjacent supporting members 66*a*, 66*c* are arranged such that a portion of the length of a third supporting member 66*c* is contiguous with, and overlaps, the first supporting member 66*a*. The arrangement is such that the overlapping portion extends between, and is supported by, two parallel secondary support members 78.

Secondary support members 78 and corresponding base members 80 are located beneath the supporting members 66 in a plurality of substantially parallel lines. The placement and number of the parallel lines can be determined by the requirements of a particular construction.

Preferably, the supporting members 66 are tiled in an offset pattern as shown in FIG. 3.

It will be appreciated that the support structure 62 of the flooring assembly 60 can be constructed in a sequential fashion from an initial location. When the support structure 62 is to be located on supporting poles (not shown), it only becomes necessary to erect a supporting pole at a location when the support structure 62 reaches that location. In this way, a building can be constructed over irregular terrain without the need for extensive site preparation.

Figure 10:
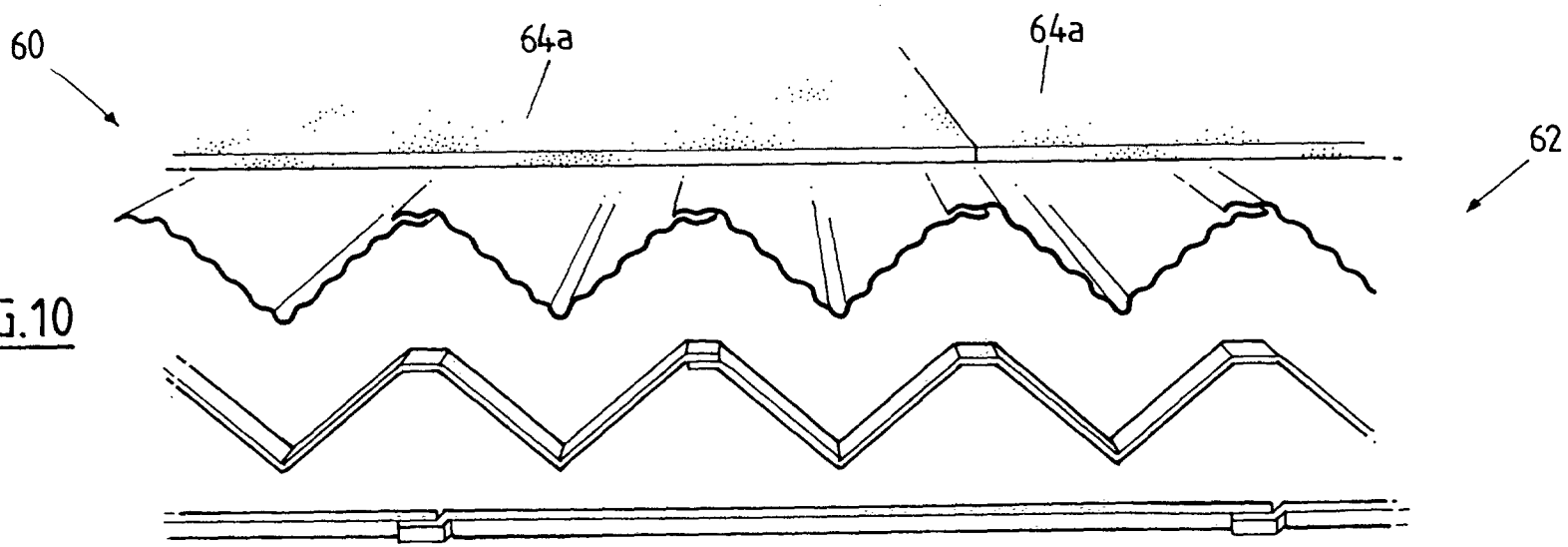
FIG. 10 is an exploded side view of a flooring assembly in accordance with the present invention.
Figure 11:
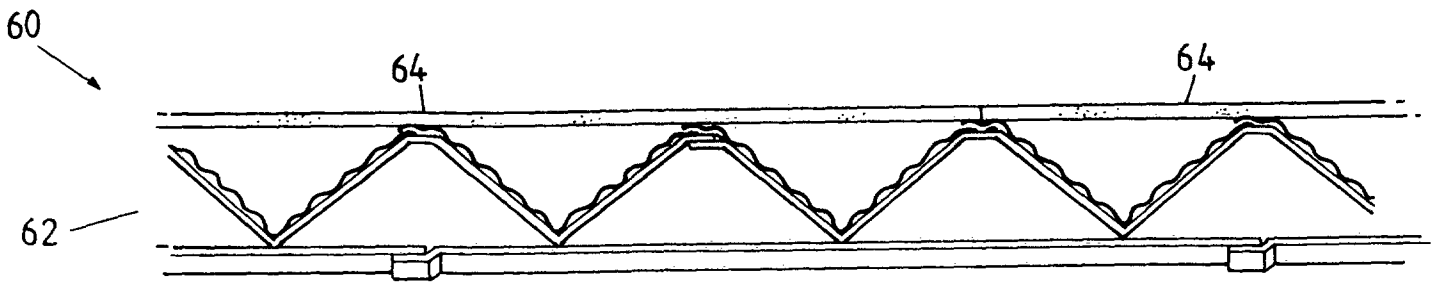
FIG. 11 is a side view of the flooring assembly of FIG. 10 in an assembled configuration.

The flooring assembly 60 of the present invention is completed by the use of the substantially planar covering members 64. The covering members 64 are comprised of flooring sheets 64*a*. The completed flooring assembly is shown in FIGS. 10 and 11.

Each flooring sheet 64*a* is fixed to the supporting members 66 by suitable means such as a fastener passing through the side portions 74, 76 of adjacent supporting members 66 and an associated secondary support member 78. In this way the flooring sheet 64*a* engages the supporting members 66 and acts to lock them in position relative to one another.

Figure 12:
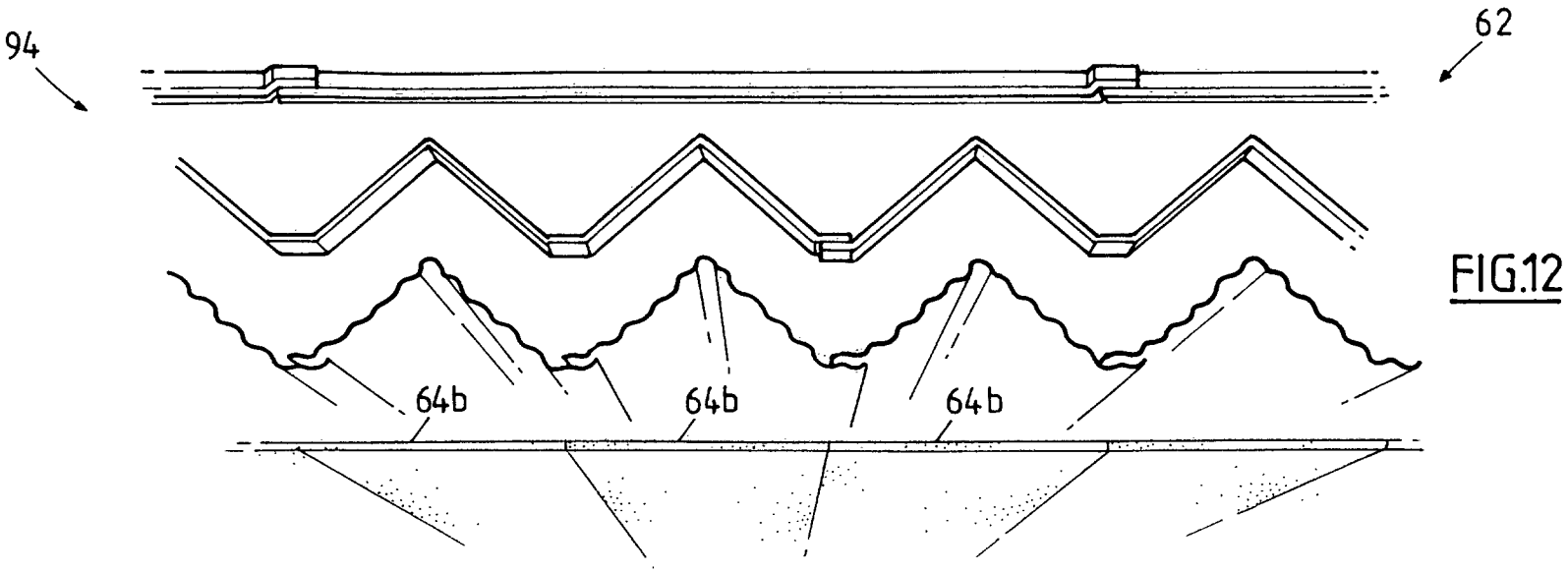
FIG. 12 is an exploded side view of a ceiling assembly in accordance with the present invention.
Figure 13:
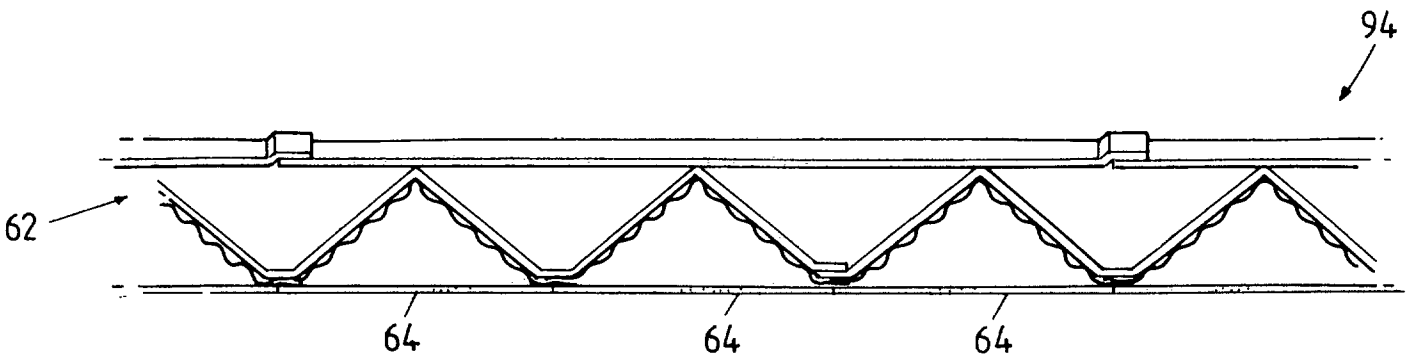
FIG. 13 is a side view of the ceiling assembly of FIG. 12 in an assembled configuration.

FIGS. 12 and 13 show a ceiling assembly 94. The ceiling assembly 94 is substantially similar to the flooring assembly 60, however is inverted with respect to the flooring assembly 60. The ceiling assembly 94 has a support structure 62 similar to that of the flooring assembly 60, and a plurality of covering members 64 comprised of ceiling sheets 64*b*, such as cement sheeting.

In a preferred embodiment of the ceiling assembly 94, each ceiling sheet 64*b* corresponds to an associated supporting member 66, and is sized so as to abut an adjacent ceiling sheet 64*b* when the supporting members 66 are tiled as described herein above with respect to the flooring assembly 60.

Figure 14:
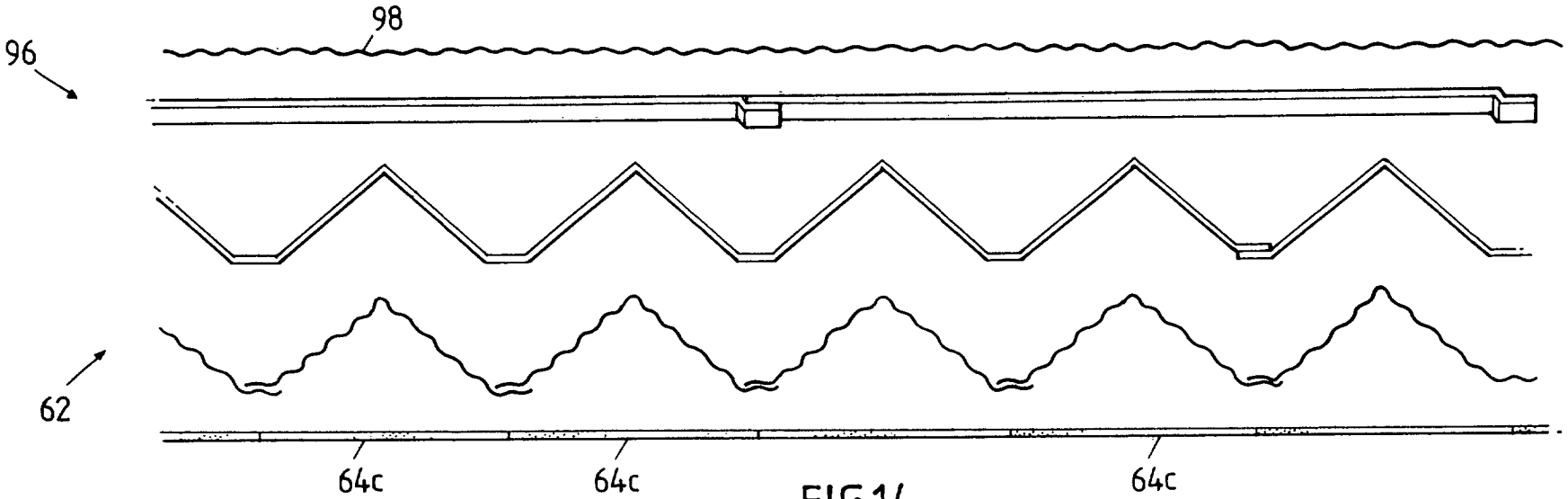
FIG. 14 is an exploded side view of a roofing assembly in accordance with the present invention.
Figure 15:
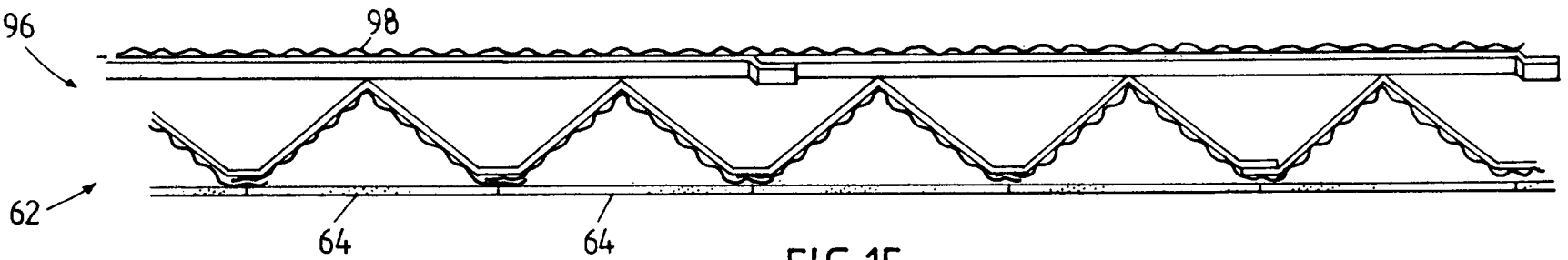
FIG. 15 is a side view of the roofing assembly of FIG. 14 in an assembled configuration.
Figure 16:
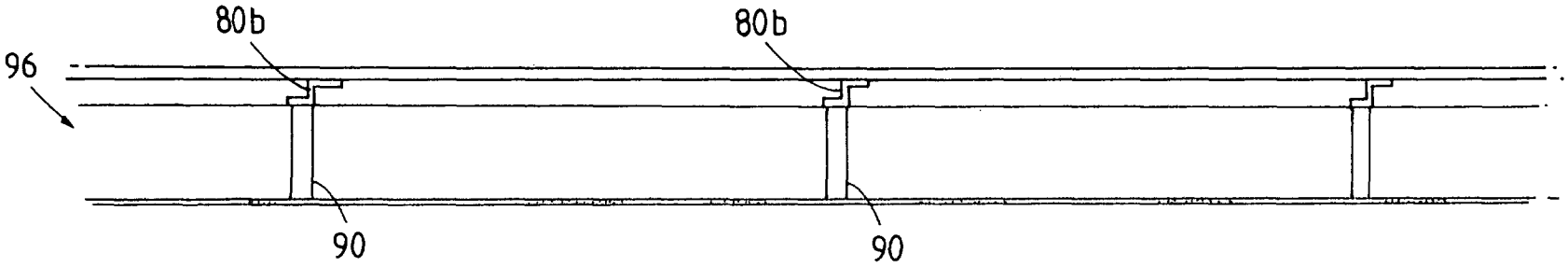
FIG. 16 is an end view of the roofing assembly of FIG. 15.

FIGS. 14 to 16 show a roofing assembly 96. The roofing assembly 96 is substantially similar to the ceiling assembly 94, with the covering members 64 comprising of an eves lining sheet 64*c*. In the roofing assembly 96 the base member 80 is preferably a "Z" purlin 80*b*, to which is attached corrugated roofing sheets 98.

The roofing assembly 96 is erected in a manner similar to that of the ceiling assembly 94, but is erected at a suitable pitch. Preferably, supporting struts 99 extend from the ceiling assembly 94 to support the roofing assembly 96 during construction.

Figure 17:
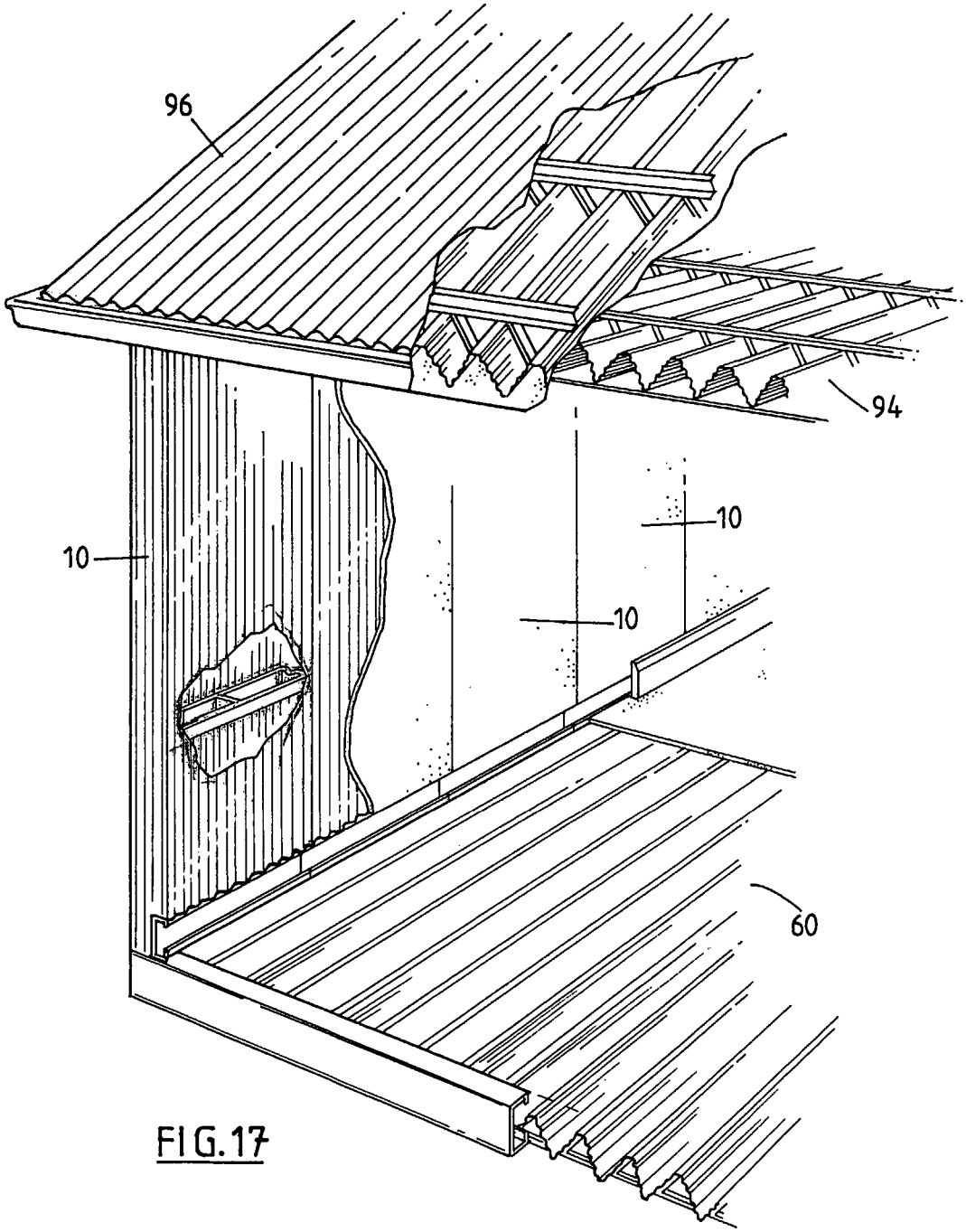
FIG. 17 is a partially cut away view of a building constructed of constituent assemblies in accordance with the present invention.

FIG. 17 shows a building 100 having a flooring assembly 60, wall panels 10, a ceiling assembly 94 and a roofing assembly 96 all in accordance with the present invention.

Modifications and variations as would be apparent to a skilled addressee are deemed to be within the scope of the present invention.

The invention claimed is:

1. A wall panel comprising a supporting structure and at least one covering member, the supporting structure having at least one integral supporting member adjacent the at least one covering member, wherein the supporting member has a first side portion extending beyond the at least one covering member and a second side portion immediately adjacent the at least one covering member, a receiving area being defined between the second side portion and the at least one covering member, wherein a first wall panel, a second wall panel and a third wall panel can be sequentially connected, such that the first side portion of the supporting member of the first wall panel is receivable within the receiving area of the second wall panel, the first side portion being complementary in shape to the second side portion such that the first side portion of the first wall panel engages the second side portion of the second wall panel, the engagement restraining relative movement of the first and second wall panels in at least one direction and the first side portion of the first wall panel locates against the at least one covering member of the second wall panel, the at least one covering member restraining relative movement of the first and second wall panels in a second direction; and the first side portion of the supporting member of the second wall panel is receivable within the receiving area of the third wall panel, the first side portion being complementary in shape to the second side portion such that the first side portion of the second wall panel engages the second side portion of the third wall panel, the engagement restraining relative movement of the second and third wall panels in at least one direction and the first side portion of the second wall panel locates against the at least one covering member of the third wall panel, the at least one covering member restraining relative movement of the second and third wall panels in a second direction, wherein the supporting structure includes two opposed supporting members.

2. A wall panel as claimed in claim 1, wherein the first and second side portions are corrugated.

3. A wall panel as claimed in claim 1, wherein the supporting members each have a transverse portion extending internally of the wall panel from the second side portion, the transverse portions engaging each other.

4. A wall panel as claimed in claim 1, wherein the transverse portions are corrugated.

5. A wall panel as claimed in claim 1, wherein the wall panel supporting structure includes at least one bracing member located internally of the wall panel, the bracing member being in contact with each of the supporting members.

6. A wall panel as claimed in claim 5, wherein each bracing member includes apertures aligned with apertures of the transverse portions of the supporting members to allow connection of corresponding bracing members of adjacent wall panels.

7. A wall panel as claimed in claim 1, wherein the at least one covering member is fixed to the supporting member.

* * * * *